US006399288B2

(12) United States Patent
Larkin et al.

(10) Patent No.: US 6,399,288 B2
(45) Date of Patent: Jun. 4, 2002

(54) RAPID PROCESSING OF HIGH CONTRAST AERIAL COLOR NEGATIVE FILM

(75) Inventors: Thomas P. Larkin; Steven A. Mango, both of Honeoye Falls; Charles F. Leith; Daniel T. Kennelly, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/736,935

(22) Filed: Dec. 14, 2000

Related U.S. Application Data

(62) Division of application No. 09/544,928, filed on Apr. 7, 2000.

(51) Int. Cl.[7] ..... G03C 1/72
(52) U.S. Cl. ..... 430/497
(58) Field of Search ..... 430/497

(56) References Cited

U.S. PATENT DOCUMENTS 5,215,872 A 6/1993 Goto et al.
5,804,356 A 9/1998 Cole et al.
5,807,666 A 9/1998 Adin et al.
5,840,470 A 11/1998 Bohan et al.
5,972,585 A 10/1999 Sowinski et al.

FOREIGN PATENT DOCUMENTS

EP 0 905 561 A1 3/1999
EP 0 969 318 A1 1/2000

OTHER PUBLICATIONS

Aerial Data, "Kodak Aerocolor II Negative Film 2445", Kodak Publ. AS–70, Rev 5/99.
"Image Structure Characteristics of Kodak Aerial Films", 6/99, TI2472, Eastman Kodak Company, 1999.

*Primary Examiner*—Hoa Van Le
(74) *Attorney, Agent, or Firm*—J. Lanny Tucker

(57) ABSTRACT

High contrast color images can be obtained from aerial color photography by rapidly processing certain color photographic silver halide films with a color developing composition under certain conditions. The color developing composition can have a pH of from about 10.2 to about 10.6 and a color developing agent at a concentration of least 0.015 mol/l. Color development is carried out for less than 180 seconds at from about 40 to about 42° C. The resulting color images have a contrast greater than 0.83, low $D_{min}$, low granularity and high sharpness and resolution.

9 Claims, No Drawings

RAPID PROCESSING OF HIGH CONTRAST AERIAL COLOR NEGATIVE FILM

CROSS-REFERENCE TO RELATED APPLICATION

This is a divisional of application Ser. No. 09/544,928 filed Apr. 7, 2000, now allowed.

FIELD OF THE INVENTION

This invention is directed to a method of providing a high contrast color image in color negative films. In particular, it is directed to rapidly processing high contrast, unmasked aerial color negative films. This invention is directed to the photographic industry.

BACKGROUND OF THE INVENTION

Aerial photography is almost as old as photography itself. As soon as people were able to rise above the earth using man made conveyances, the usefulness of imaging various features on the ground was immediately evident. Aerial photography using color photographic films is more recent, but still decades old. The particular characteristics required for such films are high contrast, low minimum density ($D_{min}$) and high resolution (ability to reproduce fine detail) and sharpness. Achieving all of these features at the same time requires specific film formulation and processing conditions especially color development. Not just any conventional color negative film or color developing composition can be used in this manner.

Improved visual contrast may be provided by enhancing film sensitivity in certain regions of the electromagnetic spectrum. For example, U.S. Pat. No. 5,807,666 (Adin et al) describes aerial films that are sensitized in the infrared region to better display tonal separation, provide better haze penetration and improve sensitivity under low visible light conditions.

Specific color negative films designed for aerial photography have been commercialized for many years, for example as KODAK AEROCOLOR Negative Films (Eastman Kodak Company). Such films generally have compositions and structures that are common to multi-color negative films that are processed using conventional Process C-41 processing conditions and chemistry, except that what is known as "color correcting chemistry" is typically omitted from the films. Such chemistry is common for conventional general consumer products where color enhancement and reproduction are essential.

Users of aerial films prefer to obtain images that depict the features on the ground as accurately as possible in what is known as "direct negative interpretation". In addition, the color negative images should be high in contrast and resolution.

Some conventional high-speed color negative films can be used for aerial photography, achieving the desired high contrast and resolution, if they are exposed to lengthy color development. However, there is a need in the photographic industry for a means to achieve high contrast and sharp color images in shorter times without having to make significant and costly changes to processing equipment and chemistry.

SUMMARY OF THE INVENTION

The present invention provides a first method of providing a color negative image having a contrast of at least 0.83, a $D_{min}$ less than 0.45, an rms granularity of less than 17, a modulation transfer function greater than 39 DMT, a resolving power greater than 80 at 1000:1 high contrast test target and a resolving power greater than 63 at 1.6:1 low contrast test target, the method comprising:

A) contacting an "unmasked" color negative silver halide photographic film with a color developing composition having a pH of from about 10.2 to about 10.6 and comprising at least 0.006 mol/l of a color developing agent, the contacting being carried out for less than 180 seconds at a temperature of from about 40 to about 42° C.

This invention also provides a second method of providing a color negative image having a contrast of at least 0.8, a $D_{min}$ less than 0.41, an rms granularity of less than 16, a modulation transfer function greater than 39 DMT, a resolving power greater than 100 at 1000:1 high contrast test target and a resolving power greater than 63 at 1.6:1 low contrast test target, the method comprising:

A) contacting an "unmasked" color negative silver halide photographic film with a color developing composition having a pH of from about 9.8 to about 10.2 and comprising at least 0.01 mol/l of a color developing agent, the contacting being carried out for at least 240 seconds at a temperature of from about 37 to about 39° C.

We have found that the first method of the present invention provides a high contrast color image with low minimum density, very high resolution and low granularity. This type of color image is obtained from an unmasked color negative silver halide photographic film that is color developed for less than 180 seconds at from about 40 to about 42° C. with a color developing composition having a pH of from about 10.2 to about 10.6 and comprising at least 0.006 mol/l of a color developing agent. This invention is particularly useful for providing high contrast, high resolution color images from medium to high altitude aerial photography.

The second method of the present invention is similar to the first method, but it more useful for providing the same high quality images using slightly different color development conditions, namely for at least 240 seconds (a so-called "push" process) at from about 37 to about 39° C. using a color developing composition having a pH of from about 9.8 to about 12.1 and comprising at least 0.01 mol/l of a color developing agent.

DETAILED DESCRIPTION OF THE INVENTION

The method of this invention is useful for providing a high contrast color negative image in a single- or multi-color negative photographic silver halide film. Such films generally have an aerial film speed (EAFS or ISO A equivalent) of at least 64, and preferably of at least 100. The speed or sensitivity of color negative films is inversely proportional to the exposure required to enable the attainment of a specified density above fog after processing. This film speed should not be confused with conventional film speeds designed for roll and sheet films employed in consumer photography. Different film speed parameters are used to relate aerial scene characteristics to practical exposure recommendations. Aerial film speeds can be determined as described in KODAK Aerial Exposure Computer, KODAK Publication AS-10 (February 1994).

The color negative films useful in the practice of this invention generally have an exposure latitude of at least 2 log E, and preferably of at least 2.3 log E. As is well understood in the art, exposure latitude defines the useful range of exposure conditions that may be recorded on a light sensitive element.

The photographic films used in the practice of this invention are preferably multilayer color elements having three color records. Such color records (or dye image-forming units) are sensitive to different regions of the visible spectrum (for example the primary regions). Each color record can include one or more silver halide emulsion layers sensitive to the same given region of the spectrum. The layers can be arranged in any of the various orders known in the art. The films can also contain other conventional layers such as filter layers, interlayers, subbing layers, overcoats and others readily apparent to one skilled in the art. A magnetic backing layer can be used as well as conventional transparent film supports that are also well known in the art (such as cellulose acetate and conventional film-forming polyesters).

Considerable details of film structure and composition are outlined in *Research Disclosure* publication 38957, published September 1996, and in the hundreds of publications noted therein. *Research Disclosure* is a publication of Kenneth Mason Publications, Ltd. Dudley House, 12 North Street, Emsworth, Hampshire PO10 7DQ English (also from Emsworth Design Inc, 121 West 19th Street, New York, 10011). Included within such teaching are the various useful classes of cyan, magenta and yellow dye forming couplers that can be used in the red, green and blue color records of the color negative films. Particular classes of dye forming couplers useful in the practice of this invention are the substituted phenol and α-naphthol cyan dye forming couplers, the aryl-pyrazolinone and pyrazolotriazole magenta dye forming couplers, and the β-ketocarboxyamide (specifically the benzoylacetanilides and pivaloylacetanilides) yellow dye forming couplers. The films generally have spectral sensitivities that provide a peak sensitivity in the red color record of from about 580 to about 700 nm, a peak sensitivity in the green color record of from about 500 to about 600 nm, and a peak sensitivity in the blue color record of from about 400 to about 500 nm.

The various color records of the films can include any suitable silver halide, or mixture thereof, that will provide the desired sensitometric properties described herein. Generally, such emulsions include predominantly silver bromoiodide grains wherein the iodide content is from about 0.5 to about 40 mol % based on the total silver content. Preferably, the iodide content is from about 0.5 to about 10 mol %. While the reminder of halide in the emulsions is generally bromide, there may be small amounts (less than 2 mol %) of chloride.

The silver halide grains in any of the color records can by of any desired morphology, such as cubic, octahedral, cubooctahedral, tabular or other morphologies readily apparent to one skilled in the art.

The various layers of the films can include one or more suitable binder materials or vehicles that are known in the art, including various types of gelatin and other hydrophilic colloidal materials.

It is essential that the color negative films used in this invention be "unmasked", meaning that they are substantially free of any color correcting chemistry that "masks" or "corrects" the colors (unwanted absorptions) provided by the incorporated dye forming couplers. Such unwanted absorptions result in desaturation of the desired color image reproduction. Many conventional color negative films contain yellow-colored magenta dye forming masking couplers and/or magenta-colored cyan dye forming masking couplers to contribute to blue $D_{min}$ and green $D_{min}$, respectively. Color correction is a well known technique in the photographic industry (see for example, Kapecki and Rogers, "Color Photography" in the *Kirk-Othmer Encyclopedia of Chemical Technology,* $4^{th}$ Ed., Volume 6, 1993)

Thus the films useful in this invention are substantially free of color masking couplers. By "substantially free" means the film contains such compounds at no more than 0.05 mmol/$m^2$, and preferably no more than 0.01 mmol/$m^2$ of any component that modifies the color in the noted manner.

The color negative films useful in this invention also exhibit several critical sensitometric properties when processed as described herein. First of all, they exhibit a contrast of at least 0.83, and preferably of at least 0.85. As one skilled in the art would understand, "contrast" is defined as the slope of a conventional characteristic sensitometric density vs. log (exposure) curve (i.e. D vs. log E).

In addition, for the first method of this invention, the film exhibits a minimum density ($D_{min}$) of generally less than 0.45, and preferably less than 0.43. For the second method of this invention, the film exhibits a minimum density ($D_{min}$) of generally less than 0.41, and preferably less than 0.40. This density is readily determined from the characteristic sensitometric curve described above.

Microscopic examination of a color photographic image reveals dye "clouds" suspended in gelatin binder. The subjective evaluation of this granular pattern is known as "graininess" and the measure of the density variations is the "granularity".

Measurement of granularity begins with density readings using a microdensitometer (for example, a densitometer having a 48-μm diameter aperture) at a net diffuse density of 1.0 above base density. The small aperture measures fluctuations in density and the standard deviation from average is called the root-mean-square (rms) granularity and is expressed in terms of diffuse granularity.

Since standard deviation numbers are very small, they are multiplied by 1000, yielding a small whole number, typically between 5 and 50. Diffuse rms granularity numbers are used to classify graininess. The procedure for measuring graininess is similar to the industrial standard known as ANSI PH2.40-1985. The films useful in this invention exhibit a rms granularity of less than 17 and preferably less than 16.

The sharpness of photographic films is a subjective perception of good edge distinction between details in an image. However, the boundary between dark and light details is not a perfectly sharp line. The dark areas in a negative film tend to bleed over into the light areas because of light scattering (or diffusion) within the silver halide emulsion. This effect varies with different types of silver halide emulsions, thickness of films, DIR and DIAR chemistry, antihalation properties of the film support and any backside layers.

In the photographic industry, sharpness if measured using a parameter known as "modulation transfer function" (MTF) that involves the use of sine-wave targets. A sine-wave target is a test target of alternating back and white lines (similar to test targets used to measure resolution, described below), except that it has continuously changing values instead of constant values. The frequency of a given test target is noted in cycles per millimeter, and a cycle is one complete sine wave. Thus, MTF shows the loss of sharpness caused primarily by light scattering within the silver halide emulsion during exposure.

The films useful in this invention have MTF values measured using a method similar to that of ANSI Standard PH2.39-1977 (R1986). The films are exposed with the specified illuminant to spatially varying sinusoidal test patterns having an aerial image modulation of a nominal 35% at the image plane, with processing as indicated. The films useful in the present invention exhibit a modulation transfer function greater than 39 DMT, and preferably greater than 40 DMT.

Resolving power is another term for "resolution". This photographic parameter refers to the ability of a film to reproduce fine detail. Resolution can be measured by photographing resolution targets or charts under specific test conditions. Typical resolution targets have several groups of parallel lines or bars. The spaces between the bars are the same as the width of the bars themselves. Each group of bars differs in size from adjacent groups by a mathematical factor [such as the square root of 2 (1.414)]. These targets are photographed at a great reduction. After processing, the film image is examined through a microscope to determine the smallest group of bars that are discernible. This group of bars defines the resolution of the film. This measurement is expressed in line pairs (a bar and a space) per millimeter (mm). The method of determining resolution just described is the standard for the industry described in International Standard ISO 6328-1982.

For the films useful in the present invention, the resolution is evaluated at the high contrast test target wherein the lighting ratio (between bars and spaces) are 1000:1, and a low contrast test target wherein the lighting ratio is 1.6:1. As the image contrast is higher, the film is able to resolve finer detail. When used in the first method of this invention, it is essential that the films described herein exhibit a resolving power greater than 80 at the 1000:1 high contrast test target and a resolving power greater than 63 at the 1.6:1 low contrast test target.

Some of the commercially available color negative films that can be processed using the second method according to the present invention to achieve the desired image features include, but are not limited to, KODAK GOLD 100 and KODAK ROYAL GOLD 100 Color Negative Films.

Other useful color photographic silver halide films can be readily prepared to achieve the desired image properties by omitting the color masking chemistry (for example, color masking couplers as described above), adjusting silver and dye-forming color coupler amounts to maximize contrast, adjusting preformed image dyes to control $D_{min}$, and adjusting absorber dyes to balance film speeds. These formulation procedures would be readily apparent to one skilled in the art and would require only routine experimentation to find the desired combination of photochemistry components and silver and dye forming coupler coating coverages, especially in view of the known composition of the commercial color negative films described above.

The films described herein are processed using a color developing composition that can be provided as a single- or multi-part color developing kit. In this application, the terms "part" and "multi-part" are well understood in the photographic industry to refer to a "solution" or "multiple solutions", respectively. Generally, multi-part kits require two or more individual solutions to be mixed in a suitable fashion to provide the desired photoprocessing composition. Mixing can occur prior to or during use in the processing apparatus.

Thus, color developing compositions include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in Research Disclosure, publication 38957 (noted above.

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-N-ethyl-N-2-methanesulfonylaminoethyl)-2-methylphenylenediamine sesquisulfate, and others readily apparent to one skilled in the art. KODAK Color Developing Agent CD-4 is preferred in the practice of this invention.

In order to protect the color developing agents from oxidation, one or more antioxidants are generally included. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and salts and derivatives thereof), hydrazines, hydrazides, amino acids, ascorbic acid (and derivatives thereof), hydroxarnic acids, aminoketones, mono- and polysaccharides, mono- and polyamines, quaternary ammonium salts, nitroxy radicals, alcohols, and oximes. Mixtures of compounds from the same or different classes of antioxidants can also be used if desired. One particularly useful antioxidant is hydroxylamine sulfate.

In some embodiments, useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine antioxidant is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine.

It may be desirable to include a chemical base in the color developing composition. Particularly useful chemical bases include inorganic bases such as alkali metal or ammonium hydroxides (for example sodium hydroxide or potassium hydroxide). Other useful chemical bases are alcoholamines (such as triethanolamine, and diethanolamine).

Water-soluble or water-miscible organic solvents may also be present. Such compounds include, but are not limited to, polyols including glycols (such as ethylene glycol, diethylene glycol and triethylene glycol), polyhydroxyamines (including polyalcoholamines), and alcohols (such as ethanol and benzyl alcohol).

Another component of the color developing composition is one or more triazinylstilbene optical brightening agents in amounts readily apparent to one skilled in the art. In some publications, triazinylstilbenes are identified as "triazylstilbenes". Preferably, the useful triazinylstilbenes are water-soluble or water-dispersible. Representative compounds are shown in U.S. Pat. No. 4,232,112 (Kuse), U.S. Pat. No. 4,587,195 (Ishikawa et al), U.S. Pat. No. 4,900,651 (Ishikawa et al) and U.S. Pat. No. 5,043,253 (Ishakawa), all incorporated herein by reference with respect to such compounds. It is to be understood that at least some of these compounds can exist in various isomeric forms. Single isomers or mixtures thereof can also been used in the practice of this invention. The most preferred triazinylstilbene compounds (and isomers thereof) include the following Compounds A and B:

Various metal ion sequestering agents can also be used in the color developing compositions to minimize the adverse effects of metal ions. Polycarboxylic acid, polyaminocarboxylic acids and phosphonic acid metal ion sequestering agents useful in the present invention are well known in the art, and are described for example in U.S. Pat. No. 4,596,765 (Kurematsu et al) and *Research Disclosure* publications 13410 (June, 1975), 18837 (December, 1979) and 20405 (April, 1981). Useful sequestering agents are readily available from a number of commercial sources. Particularly useful phosphonic acids are the diphosphonic acids (and salts thereof) and polyaminopolyphosphonic acids (and salts thereof). It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily

A

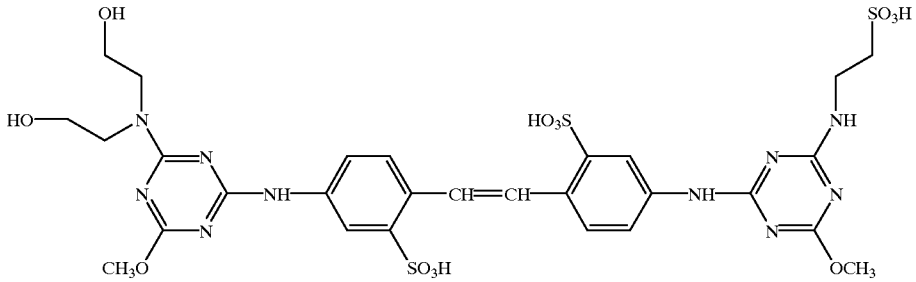

B

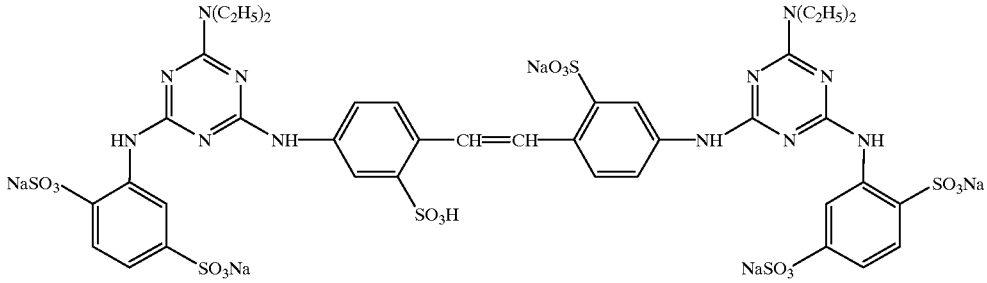

The color developing composition can also includes one or more buffering agents to provide or maintain desired alkaline pH. These buffering agents preferably have a pKa of from about 9 to about 13 and include, but are not limited to carbonates, borates, tetraborates, glycine salts, leucine salts, valine salts, proline salts, triethanolamine, diethanolamine, phosphates, hydroxybenzoates and other buffer known in the art for this purpose. Alkali metal carbonates (such as sodium carbonate, sodium bicarbonate and potassium carbonate) are preferred. Mixtures of buffering agents can be used if desired.

The pH of the color developing composition used in the first method of this invention is generally from about 10.2 to about 10.6, and preferably from about 10.35 to about 10.45. The pH of the color developing composition used in the second method of this invention is generally from about 9 to about 12, and preferably from about 9.5 to about 10.5. In defining the pH of these color developing compositions, the modifier "about" refers to variation of ±0.2 pH unit.

apparent to one skilled in the art (and alkali metal and ammonium salts thereof). The first compound is most preferred and is available as DEQUEST™ 2010. Its tetrasodium salt is available as DEQUEST™ 2016D. Both materials are available from Solutia Co. Another useful disphosphonic acid is morpholinomethanediphosphonic acid or a salt thereof. Still another useful sequestering agent is diethylenetriaminepentamethylene-phosphosphonic acid or an alkali metal salt thereof (available as DEQUEST™ 2066 from Solutia Co.).

The color developing composition can also include one or more of a variety of other addenda commonly used in photographic color developing compositions. Such addenda include alkali metal halides (such as potassium chloride, potassium bromide, sodium bromide and sodium iodide), auxiliary co-developing agents (such as phenidone type compounds particularly for black and white developing compositions), antifoggants, development accelerators, wetting agents, fragrances, stain reducing agents, surfactants, defoaming agents, water-soluble polymers (such as sulfonated polystyrene) and water-soluble or water-dispersible color dye forming couplers, as would be readily understood by one skilled in the art [see for example, the *Research Disclosure* publications noted above]. The amounts of such additives would be well known to a skilled artisan in view of their usual concentrations in working strength compositions.

For the second method of this invention, the concentration of bromide ions is important. The bromide ion concentration is at least 0.013 mol/l, and preferably from about 0.018 to about 0.2 mol/l. Bromide ions can be supplied as one or more alkali metal or ammonium salts. Sodium bromide is preferred.

The following TABLE I lists the general and preferred amounts of color developing agents for both methods of this invention. The preferred ranges are listed in parentheses ( ), and all of the ranges are considered to be approximate or "about" at the upper and lower end points.

TABLE I

| COMPONENT | AMOUNT(S) |
|---|---|
| Color developing agent(s) (first method) | 0.006–0.024 mol/l (0.012–0.018 mol/l) |
| Color developing agent(s) (second method) | 0.01–0.028 mol/l (0.016–0.022 mol/l) |

Color development of an imagewise exposed photographic silver halide film is carried out by contacting the element with a color developing composition prepared according to this invention under suitable time and temperature conditions, in suitable processing equipment, to produce the desired color image. The color developing agent reduces developable silver halide and is oxidized in the process. Oxidized color developing agent in turn reacts with the dye forming color couplers in the film to yield the desired dyes.

Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions (times and temperature), replenishment rates, and processing compositions useful therefor are well known for the various processing protocols including the conventional Process C-41 processing of color negative films, but with the modifications described herein. In addition, with the exception of the novel color developing step described herein, the films can be processed using conventional KODAK EA-5 Chemicals and KODAK AN-5 Chemicals using Process AN-5, as described in "Aerial Data", Kodak Publication AS-70 (revised May, 1999).

Processing according to the present invention can be carried out using any suitable processing machine including those having deep tanks for holding processing solutions and using roller transport for conveying the films through the various tanks. Useful commercial processing machines include, but are not limited to, KODAK Aerial Color Processor, Model 1611 and KODAK EKTACHROME RT Processor, Model 1811 (with Quick-Change). Alternatively, it can be carried out using what is known in the art as "low volume thin tank" processing systems, or LVTT, which have either a rack and tank or automatic tray design. These processors are sometimes known as "minilab" processing machines. Such processing methods and equipment are described, for example, in U.S. Pat. No. 5,436,118 (Carli et al) and publications noted therein.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Useful fixing agents are also well known in the art and include various thiosulfates and thiocyanates or mixtures thereof.

The processing time and temperature used for each processing step of the present invention following color development are generally those conventionally used in the art (for example, Process C-41 and Process AN-5).

The photographic processing compositions necessary for the practice of this invention (such as color developing, bleaching, fixing or bleach/fixing compositions) can be provided in any suitable form, including dry tablets, granules or powders, or as concentrated or diluted aqueous solutions. Such compositions (such as the color developing composition used in the first method) and samples of the "unmasked" films described herein can be provided individually or as part of a "kit" containing the combination of the film and one or more photographic processing compositions (such as the color developing composition described above) in dry or wet form. If such compositions are in wet form, they can be provided at any suitable volume and in any suitable container (for example "cubitainers", bottles, pouches, packets, vials or drums).

Color development, on the other hand, is generally carried out at specific conditions for each method of this invention. In defining these color development conditions, the term "about" refers to a variation of ±0.5° C., and ±15 seconds.

For the first method of this invention, the film is color developed at a temperature of from about 40 to about 42° C. for less than 180 seconds, and preferably for from about 170 to about 175 seconds.

For the second method of this invention, the film is color developed at a temperature of from about 37 to about 39° C. for at least 240 seconds, and preferably for from about 240 to about 285 seconds.

The following examples are included to illustrate the practice of the present invention, but the scope of the invention is not to be interpreted as being so limited.

EXAMPLE 1

Processing of Color Negative Films

Samples of KODAK GOLD 100 Color Negative Film were imagewise exposed and processed using the following protocol and processing compositions in a commercially available KODAK Aerial Color Processor, Model 1611. The film samples were run through the processor at about 0.4 m/min and the color developing composition replenishment rate was about 1350 ml/m$^2$. All other processing compositions used in this example were replenished using the conventional rates for the noted processing machine.

Processing Protocol

| Processing Step | Processing Composition | Temperature (° C.) | Processing Time (sec) |
|---|---|---|---|
| Color Development | See below | 41.1 ± 0.3 | 175 |
| Stop Bath | KODAK EA-5 First & Second Stop Bath & Replenisher | 49 ± 3 | 58.9 |
| Washing | Water | 49 ± 3 | 58.9 |
| Bleaching | KODAK EA-5 Bleach & Replenisher | 49 ± 3 | 58.9 |
| Fixing | KODAK Aerial Color Fixer & Replenisher | 46 ± 3 | 58.9 |
| Final Washing | Water + KODAK EA-5 Stabilizer & Replenisher added to tank at 50 ml/min | 49 ± 3 | 176 |
| Drying | | 63 ± 3 | 88.7 |

The color developing composition used in the noted method had the following composition of major components and pH:

| Component | Amount (per liter) |
|---|---|
| KODAK Color Developing Agent 4 | 5.5 g |
| Hydroxylamine sulfate | 2.2 g |
| Sodium bromide | 1.2 g |
| Sodium sulfite | 4.0 |
| pH | 10.4 |

The desired color images were obtained having a contrast of 0.83, the rms granularity was less than 17, the modulation transfer function was about 44 DMT, the resolving power was greater than 80 at 1000:1 high contrast test target, and the resolving power was greater than 63 at 1.6:1 low contrast target.

Because these film samples contain masking couplers, the $D_{min}$ is 1.0 or outside the scope of the present invention. However, we are confident that if the masking couplers are removed from such films (that is, films having the exact composition and construction but without masking couplers), and the exposed films are processed according to the present invention, the excellent results in contrast, granularity, resolution and sharpness desirable for color aerial photography would be obtained.

EXAMPLE 2

Prospective Processing of Color Negative Films

This is a paper example. Samples of a color negative film like that processed in Example 1 except that all color chemistry is omitted, can be imagewise exposed and processed using the following protocol and processing compositions in a commercially available KODAK Aerial Color Processor, Model 1611. The film samples would be run through the processor at about 0.4 m/min and the color developing composition replenishment rate would be about 1350 ml/m$^2$. All other processing compositions used in this example would be replenished using the conventional rates for the noted processing machine.

Processing Protocol

| Processing Step | Processing Composition | Temperature (° C.) | Processing Time (sec) |
|---|---|---|---|
| Color Development | See below | 41.1 ± 0.3 | 175 |
| Stop Bath | KODAK EA-5 First & Second Stop Bath & Replenisher | 49 ± 3 | 58.9 |
| Washing | Water | 49 ± 3 | 58.9 |
| Bleaching | KODAK EA-5 Bleach & Replenisher | 49 ± 3 | 58.9 |
| Fixing | KODAK Aerial Color Fixer & Replenisher | 46 ± 3 | 58.9 |
| Final Washing | Water + KODAK EA-5 Stabilizer & Replenisher added to tank at 50 ml/min | 49 ± 3 | 176 |
| Drying | | 63 ± 3 | 88.7 |

The color developing composition to be used would have the following composition of major components and pH:

| Component | Amount (per liter) |
|---|---|
| KODAK Color Developing Agent 4 | 5.5 g |
| Hydroxylamine sulfate | 2.2 g |
| Sodium bromide | 1.2 g |
| Sodium sulfite | 4.0 |
| pH | 10.4 |

The desired color images obtained in this manner would have a $D_{min}$ of less than 0.45, a contrast of at least 0.83, an rms granularity of less than 17, a desired resolution greater than 39 DMT, a resolving power greater than 80 at 1000:1 high contrast test target, and a resolving power greater than 63 at 1.6:1 low contrast test target.

The invention has been described in detail with particular reference to preferred embodiments thereof, but it will be understood that variations and modifications can be effected within the spirit and scope of the invention.

We claim:

1. A photographic processing kit comprising:

an "unmasked" color negative silver halide photographic film that is capable of providing a color negative image having a contrast of at least 0.83, a $D_{min}$ less than 0.45, an rms granularity of less than 17, a modulation transfer function greater than 39 DMT, a resolving power greater than 80 at 1000:1 high contrast test target and a resolving power greater than 63 at 1.6:1 low contrast test target, and a photographic color developing composition that, in aqueous form, has a pH of from about 10.2 to about 10.6 and comprises at least 0.006 mol/l of a color developing agent.

2. The photographic processing kit of claim 1, wherein said color developing composition has a pH of from about 10.35 to about 10.45.

3. The photographic processing kit of claim 1, wherein said color developing composition comprises said color developing agent at a concentration of from about 0.006 to about 0.024 mol/l.

4. The photographic processing kit of claim 1, wherein said color negative silver halide photographic film has an aerial film speed of at least 64.

5. The photographic processing kit of claim 1, wherein said color negative silver halide photographic film is a multicolor film having red color record having a peak sensitivity of from about 580 to about 700 nm, a green color record having a peak sensitivity of from about 500 to about 600 nm, and a blue color record having a peak sensitivity of from about400 to about 500 nm.

6. The photographic processing kit of claim 1, wherein color negative silver halide photographic film has no more than 0.05 mmol/$m^2$ of color correcting chemistry.

7. The photographic processing kit of claim 1, wherein said color developing composition comprises bromide ions at a concentration of at least 0.013 mol/l.

8. The photographic processing kit of claim 7, wherein said color developing composition comprises bromide ions at a concentration of from about 0.013 to about 0.2 mol/l.

9. The photographic processing kit of claim 7, wherein said color developing composition comprises bromide ions provided as sodium bromide.

* * * * *